US010471501B2

(12) United States Patent
Fernandez Orive et al.

(10) Patent No.: US 10,471,501 B2
(45) Date of Patent: Nov. 12, 2019

(54) SAND CORE MAKING MACHINE

(71) Applicant: Loramendi, S. Coop., Vitoria-Gasteiz (ES)

(72) Inventors: Luis Alfonso Fernandez Orive, Vitoria-Gasteiz (ES); Cesar Marco Serrano, Vitoria-Gasteiz (ES); Enrique Casado Armentia, Vitoria-Gasteiz (ES)

(73) Assignee: LORAMENDI, S. COOP., Vitoria-Gasteiz (ES)

( * ) Notice: Subject to any disclaimer, the term of this patent is extended or adjusted under 35 U.S.C. 154(b) by 0 days.

(21) Appl. No.: 16/245,609

(22) Filed: Jan. 11, 2019

(65) Prior Publication Data

US 2019/0143401 A1 May 16, 2019

Related U.S. Application Data

(63) Continuation of application No. PCT/ES2017/070432, filed on Jun. 15, 2017.

(30) Foreign Application Priority Data

Jul. 19, 2016 (EP) ..... 16382344.6

(51) Int. Cl.
*B22C 13/12* (2006.01)
*B22C 15/24* (2006.01)
(Continued)

(52) U.S. Cl.
CPC ..... *B22C 13/12* (2013.01); *B22C 11/04* (2013.01); *B22C 15/24* (2013.01); *B22C 9/02* (2013.01)

(58) Field of Classification Search
CPC ..... B22C 13/04; B22C 13/12; B22C 13/14; B22C 11/00; B22C 11/02; B22C 11/04;
(Continued)

(56) References Cited

U.S. PATENT DOCUMENTS 4,942,916 A * 7/1990 Hale ..... B22C 15/24 164/186
5,014,766 A 5/1991 Weber

FOREIGN PATENT DOCUMENTS

CN 102626772 B 10/2013
DE 3148461 C1 4/1983
(Continued)

OTHER PUBLICATIONS

Houard et al., Equipements Pour Le Moulage Et Le Noyautage, 876 Fonderie-Fondeur d'aujourd'hui, (1994)Aout/ Sep., No. 137, Paris, FR, 8 pages.

(Continued)

*Primary Examiner* — Kevin P Kerns
*Assistant Examiner* — Steven S Ha
(74) *Attorney, Agent, or Firm* — Edell, Shapiro & Finnan, LLC

(57) ABSTRACT

A sand core making machine is provided that includes at least one transfer tool by means of which the material for making the core is transferred when said transfer tool is moved to an operating position. The machine also includes a curing tool by means of which the material previously transferred by the transfer tool is hardened and which is arranged in an operating position over the material to perform the hardening once the transfer tool has moved out of its operating position. The machine includes at least one articulated arm for moving the transfer tool and the curing tool to the respective operating position.

20 Claims, 3 Drawing Sheets

(51) Int. Cl.
*B22C 11/04* (2006.01)
*B22C 9/02* (2006.01)

(58) Field of Classification Search
CPC .. B22C 15/24; B22C 9/02; B22C 9/12; B22C 9/123; B22C 9/126
See application file for complete search history.

(56) References Cited

FOREIGN PATENT DOCUMENTS

| | | | |
|---|---|---|---|
| DE | 4225577 | A1 | 2/1994 |
| EP | 0284967 | A2 | 10/1988 |
| EP | 0444431 | A2 | 9/1991 |
| EP | 0494762 | A2 | 7/1992 |
| EP | 2511026 | A2 | 10/2012 |
| EP | 2907601 | A1 | 8/2015 |
| EP | 3272441 | A1 | 1/2018 |
| WO | 2005014204 | A1 | 2/2005 |
| WO | 2014187671 | A1 | 11/2014 |

OTHER PUBLICATIONS

Aslanowicz et al., Conceptual Design of a Core Making System, Archives of Foundry Engineering, ISSN (1897-3310), vol. 13, Special Issue Jan. 2013, pp. 13-16.
Extended European Search Report in corresponding European Application No. 16382344.6, dated Jan. 23, 2017, 10 pages.
International Search Report and Written Opinion in corresponding International Application No. PCT/ES2017/070432, dated Nov. 27, 2017, 14 pages.

* cited by examiner

SAND CORE MAKING MACHINE

CROSS-REFERENCE TO RELATED APPLICATIONS

This application is a continuation of International Application No. PCT/ES2017/070432, filed Jun. 15, 2017, which relates to and claims the benefit and priority to European Application No. EP 16382344.6, filed Jul. 19, 2016.

TECHNICAL FIELD

The present invention relates to sand core making machines.

BACKGROUND

Sand core making machines are used to produce sand cores which in turn are subsequently used to produce cavities or recesses in cast parts. Generally, the material used for making a core is not only sand, it is a mixture comprising sand, preferably mixed with a kind of resin, although the cores made in this type of machines are commonly known as sand cores.

Machines of this type are normally included in installations comprising, in addition to one of these machines, another machine where casting is performed. In these installations the corresponding sand core produced in the sand core making machine is transported to another machine where casting is performed by suitable conveyance means. There are different types of conveyance means (such as robots or conveyor belts, for example) and machines to perform casting that are not described in detail as they are not an object of the invention.

In conventional sand core making machines, to perform said production the material for making the core is transferred to a core box comprising a lower shaping tool and an upper shaping tool between which a cavity is defined with the desired core shape (the material is transferred to the cavity). The shaping tools are arranged in a working position in which the material is transferred, and to that end the upper shaping tool moves by means of hydraulic actuation or the like, primarily due to its weight and therefore to the force required to perform said movement, guided by said structure, until being arranged in collaboration with the lower shaping tool to generate the cavity with the desired core shape. This type of movement is also referred to as carriage-like movement, as it is a linear movement guided by a structure. The lower shaping tool remains fixed in the structure of the machine.

Subsequently, a blowing head (or transfer tool) is transported to an operating position like a carriage (linear movement guided by a structure) by means of hydraulic actuation or the like primarily due to its substantial weight, and therefore to the force required to perform said movement, and guided by the structure of the machine, in which it is arranged on the shaping tools, and with said blowing head in said operating position, the material for making the core is transferred to the cavity generated between both shaping tools through the blowing head, generally comprising a plurality of nozzles for such purpose. The transfer is performed with the help of compressed air.

After transferring the material to the cavity formed between both shaping tools, the blowing head is removed from its operating position and a curing plate (a curing tool) moves to an operating position like a carriage (linear movement guided by a structure) by means of hydraulic actuation or the like, primarily due to its substantial weight and therefore to the force required to perform said movement, and guided by the structure of the machine, in which said curing plate is arranged on the shaping tools. With the curing plate in said operating position, the material previously transferred by the transfer tool is hardened, preferably by means of the application of a gas to the cavity generated between both shaping tools by means of said curing plate. The hardened material corresponds with the generated sand core.

Once the sand core is generated, the lower and upper shaping tools are separated from one another, such that the sand core is accessible, arranged on one of the shaping tools, so it can be handled (for example to convey it to the casting machine).

A sand core making machine is disclosed for example in EP0494762A2, and also in EP2907601A1 belonging to the applicant itself. The machine disclosed in EP2907601A1 comprises a transfer tool by means of which the material for making the core is transferred when said transfer tool is moved to an operating position, in particular over the cavity generated between a lower shaping tool and an upper shaping tool, by means of a carriage-like structure with guided linear movement. Once all the material (or the required material) has been unloaded, the transfer tool is removed from its operating position by means of the carriage-like structure, and simultaneously a curing tool is moved to an operating position by means of a respective carriage-like structure, position in which it is arranged on the material previously transferred with the transfer tool. By means of said curing tool, with said curing tool in its operating position, the material present in the cavity is hardened.

The patent document EP0284967A2 discloses a sand core making machine comprising a transfer tool for the core sand, and an articulated arm to rotate the transfer tool between an operation position and a none-operation position.

SUMMARY

A machine is provided that includes at least one transfer tool by means of which the material for making the core is transferred when said transfer tool is moved to an operating position, and a curing tool by means of which the previously transferred material is hardened and which is arranged in an operating position in which it is arranged over said previously transferred material to perform said hardening once the transfer tool has moved out of its operating position.

The machine further comprises at least one articulated arm for moving the transfer tool and the curing tool to the respective operating position. Therefore, since at least one articulated arm is used, the machine is simplified because, for example, structures with carriage-like linear movement are not required, making the design and maintenance of the machine easier, for example. Furthermore, since at least part of the structure thereof is eliminated, a more compact and more user-accessible machine (for both maintenance and cleaning and handling different elements if required) can be obtained.

These and other advantages and features will become evident in view of the drawings and the detailed description.

DETAILED DESCRIPTION

Figure 1A:
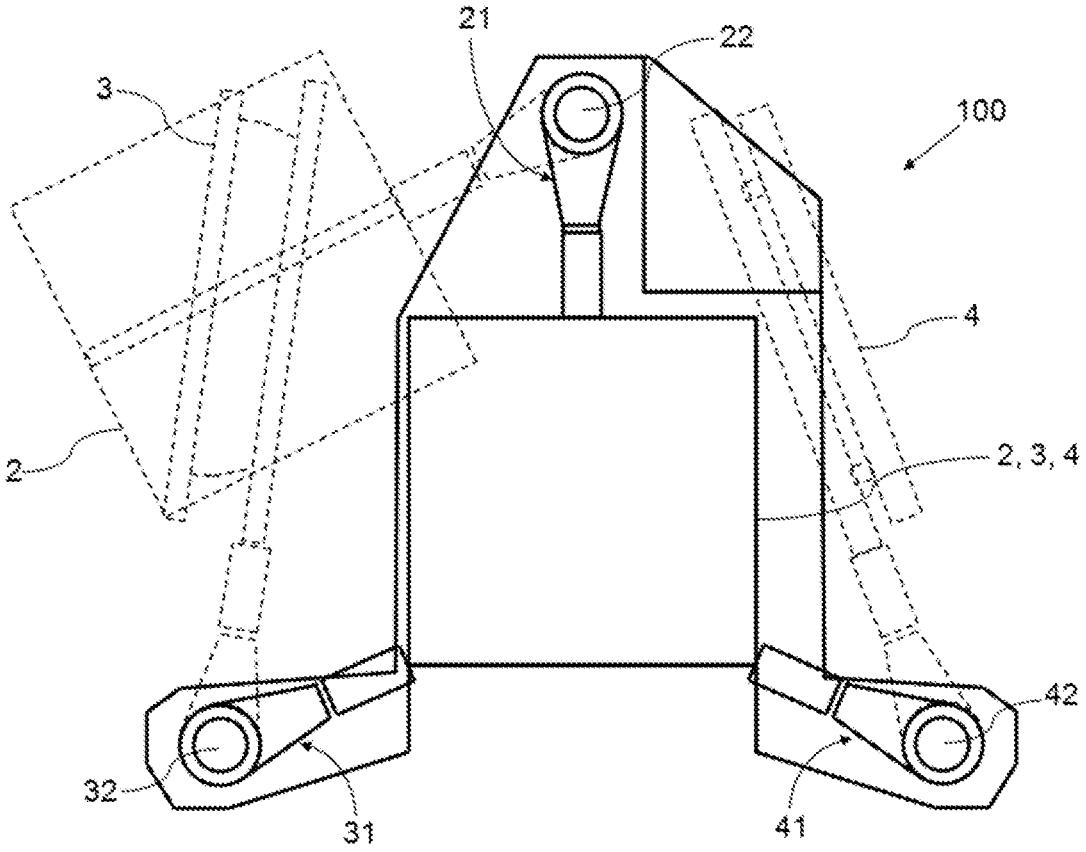
FIG. 1A shows a schematic plan view of a sand core making machine according to one embodiment.
Figure 1B:
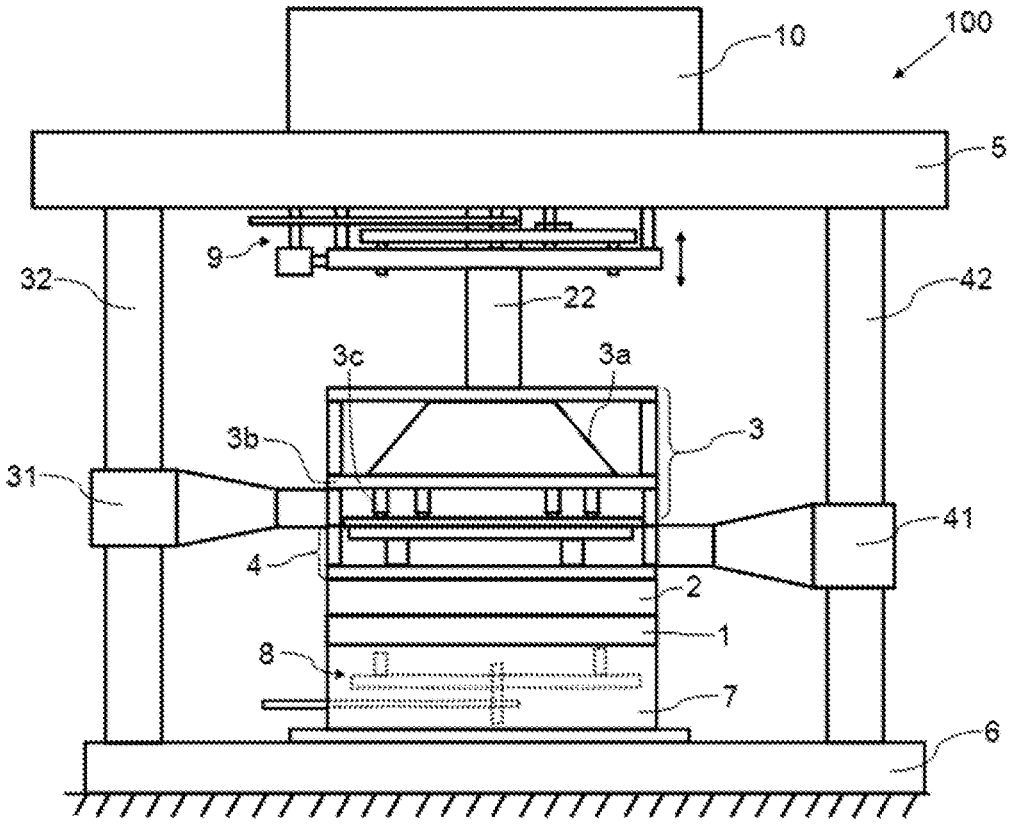
FIG. 1B shows a schematic side view of the sand core making machine with the shaping, transfer and curing tools stacked on top of one another.

Machine 100 is a sand core making machine as the one shown by way of example in FIGS. 1A and 1B. Generally, the material that is used to generate a core is not just sand, but rather a mixture comprising sand, preferably mixed with a kind of resin, although the cores made in machines of this type are commonly known as sand cores.

Figure 2:
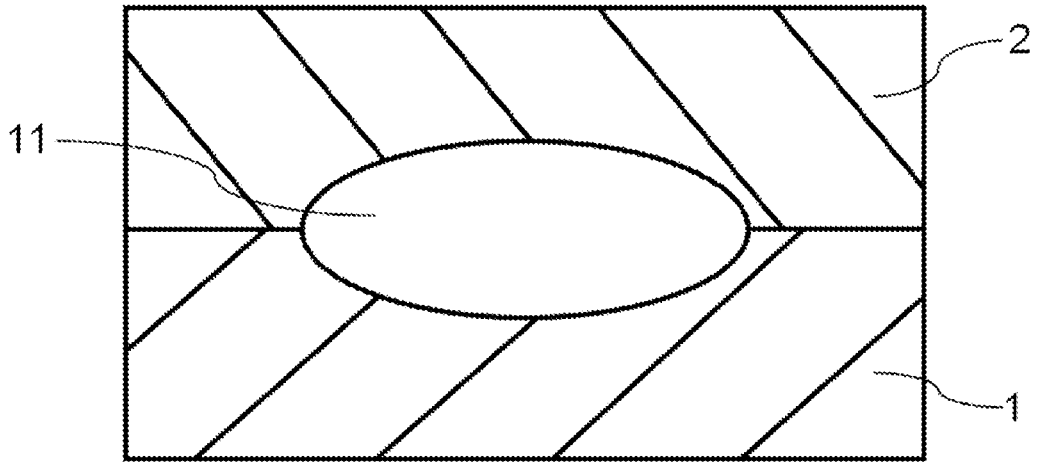
FIG. 2 schematically shows a sectional view of a lower shaping tool and an upper shaping tool in the working position, defining a cavity with the shape of the core to be made.

A sand core making machine 100 according to the embodiment shown in the figures comprises a lower shaping tool 1 (lower impression) and an upper shaping tool 2 (upper impression) between which a cavity 11 is generated with the shape desired for the core to be made when the upper shaping tool 2 is arranged on the lower shaping tool 1, as shown by way of example in FIG. 2, in a working position of both shaping tools 1 and 2. The sand core is thereby made with both shaping tools 1 and 2 in the working position.

The machine 100 further comprises a transfer tool 3 by means of which the material for making the core is transferred to the cavity 11 when the shaping tools 1 and 2 are in the working position, and which is moved to an operating position for arranging it on said shaping tools 1 and 2 when the latter are in said working position. In the operating position, the transfer tool 3 is used for transferring the material for making the core to the cavity 11 generated between the shaping tools 1 and 2. The transfer tool 3 can comprise a hopper 3*a* where the material is arranged to be transferred (hopper 3*a* where the material has previously been introduced), and a blowing plate 3*b* fixed under the hopper 3*a* and arranged between the shaping tools 1 and 2 and the hopper 3*a* when the transfer tool 3 is in the operating position, and comprising at least one nozzle 3*c* through which the material is transferred from the hopper 3*a* to the cavity 11. The material is preferably transferred by pressure, and with the help of gravity it is suitably deposited in the cavity 11.

The machine 100 further comprises a curing tool 4 by means of which a fluid is applied to the material arranged in the cavity 11 when the shaping tools 1 and 2 are in the working position, and which is arranged in an operating position for arranging it over said shaping tools 1 and 2 when the latter are in said working position and once the transfer tool 3 has transferred the material to the cavity 11 and has moved out of its operating position. In its operating position, the curing tool 4 is used for applying a fluid to the sand present in the cavity 11, which has previously been transferred to said cavity 11 by means of the transfer tool 3. The fluid can be air or any other type of gas and is preferably applied under pressure.

The shaping tools 1 and 2 are arranged in a specific working position for making a core, and the tools 3 and 4 move suitably until being located on said shaping tools 1 and 2, in a respective operating position, when the latter are in said working position, to perform the operations required for making said core. With said shaping tools 1 and 2 in the working position, firstly the transfer tool 3 is arranged on them in an operating position of the transfer tool 3, and the material is transferred to the cavity 11. Preferably, during said operation the transfer tool 3 is held down against the shaping tools 1 and 2 to keep it in place by hold-down means 9 actuated by specific actuation means 10. Said transfer tool 3 is subsequently taken out of said operating position, moving it to its initial position for example, thereby leaving the space on the working tools 1 and 2 (which remain in their working position) free. Once the transfer tool 3 has been taken out of its operating position, the curing tool 4 is arranged on said shaping tools 1 and 2 in an operating position of said curing tool 4, and said curing tool applies the corresponding fluid in the cavity 11 for hardening the material present therein. The movement of the tools 3 and 4 can be synchronized to optimize process times. Preferably, during said operation the curing tool 4 is held down against the shaping tools 1 and 2 to keep it in place by hold-down means 9 actuated by actuation means 10 (the same hold-down means 9 and actuation means 10 used for holding down the transfer tool 3).

Once the material present in the cavity 11 is cured, at least one of the shaping tools 1 and 2 is operated in order to leave the sand core that has been made (the material cured in the cavity 11) accessible, such that said sand core can be transported to wherever required. For example, the upper shaping tool 2 can be separated from the lower shaping tool 1 (together with the curing tool 4, for example, or separately therefrom), and the core can be ejected from the lower shaping tool 1 by ejection means 8, thereby being readily accessible (for a user, a tool or for a robot or other conveyance means, for example). Generally, the lower shaping tool 1 is fixed to a base or frame 7, on said frame 7, and said frame 7 houses the ejection means 8.

Preferably, the lower shaping tool 1, together with the frame 7, where appropriate, first moves to the working position and is fixed there. Subsequently, the upper shaping tool 2 moves until being arranged on the lower shaping tool 1 to generate the cavity 11 defining the shape of the core to be made between both shaping tools 1 and 2. The shaping tools 1 and 2 also depend on the core to be made, so if the shape of the core to be made differs from the shape of the previously made core, the shaping tools 1 and 2 must be replaced with shaping tools 1 and 2 having a shape suitable for the core to be made.

The machine 100 comprises at least one articulated arm for moving the transfer tool 3 and the curing tool 4 to the respective operating position (and for taking said tools 3 and 4 out of their respective operating position), although in a preferred embodiment the machine 100 comprises a respective articulated arm 31 and 41 for each of said tools 3 and 4. Therefore, said tools 3 and 4 are readily moved to their operating position and from their operating position to a position away from said operating position, allowing for a simple operation for making a core. These movements are furthermore performed without requiring a structure for guiding the tools 3 and 4 and without requiring complex actuation means, since controlling the actuation of the articulated arm (or articulated arms 31 and 41) is enough for that purpose. Therefore, the need to incorporate a guiding structure for the movement of said tools 3 and 4, which would increase the size of the machine 100 and limit the space available for a user, is eliminated. The installation of the machine 100 and its maintenance and cleaning are therefore made easier, which furthermore entails a cost reduction and makes user access to the different parts of the machine 100 easier.

Furthermore, as a result of the space that is freed up in the machine 100, replacing the tools 3 and 4 and shaping tools 1 and 2 to meet the needs of a new core to be made (different from the previously made core), replacing said tools 1, 2, 3 and 4 is easier since it is easier to access same so they can be operated and arranged in the respective positions for the process of making cores.

The machine 100 further comprises at least one vertical support for supporting the articulated arm (or articulated arms 31 and 41), said articulated arm being vertically movable on said vertical support and said articulated arm being attached to the support with rotational freedom. In the preferred embodiment, the machine 100 comprises a respective vertical support 32 and 42 for each articulated arm 31 and 41, which simplifies the machine 100 and makes it easier to design same as each vertical support 32 and 42 and each articulated arm 31 and 41 is considered separately.

In the preferred embodiment, the machine 100 comprises an additional articulated arm 21 for moving the upper shaping tool 2 and arranging it on the lower shaping tool 1. This movement is performed with the lower shaping tool 1 in the working position. Therefore, once the lower shaping tool 1 is arranged in the working position, the required movements of the tools 2, 3 and 4 are performed with respective articulated arms 21, 31 and 41, which eliminates the need for using guiding structures for that purpose. The advantages discussed above with respect to the use of articulated arms 31 and 41 (or a single articulated arm) for the tools 3 and 4 are thereby enhanced, additionally freeing up more space since guiding structures for guiding the movement of the upper shaping tool 2 are not required.

In the preferred embodiment, the machine 100 comprises an additional vertical support 22 to which the articulated arm 21 is attached with rotational freedom, said articulated arm 21 furthermore being vertically movable on said vertical support 22.

In the preferred embodiment, the three vertical supports 22, 32 and 42 are arranged such that they coincide with the vertexes of a triangle, and said triangle can furthermore be suitable for taking in the shaping tools 1 and 2 when said shaping tools 1 and 2 are in the working position, and therefore also for housing the tools 3 and 4 when the latter are in the respective operating position. In one embodiment, the vertical support 22 is arranged at a certain point of a virtual line perpendicular to a virtual line joining the other two vertical supports 32 and 42, the shaping tools 1 and 2 being arranged substantially in the center of the triangle in the working position.

The triangular arrangement of the three vertical supports 22, 32 and 42 allows arranging the vertexes of the triangle where required in order to use the space between every two vertical supports 22, 32 and 42 for different operations, something that is not possible with machines for making sand cores of the prior art. For example, a space can be left between the vertical support 32 and the vertical support 42 to allow extracting the sand core from the machine 100 there through once said core has been made. Therefore, the made core can be accessed in a simple manner by the required means (the space can therefore depend on the required means, which can be a user for manually extracting the core, a robot or a specific tool supporting and conveying the core, for example).

The distance between the vertical support 22 and any of the other two vertical supports 32 and 42 can be such that when the upper shaping tool 2 is moved by means of the articulated arm 21, said upper shaping tool 2 does not collide with any of the vertical supports 32 and 42; when the transfer tool 3 is moved by means of the articulated arm 31, said transfer tool 3 does not collide with the vertical support 22; and when the curing tool 4 is moved by means of the articulated arm 41, said curing tool 4 does not collide with the vertical support 22. Therefore, the space between the vertical supports 22 and 32 is used for the movement of the transfer tool 3 and upper shaping tool 2; the space between the vertical supports 22 and 42 is used for the movement of at least the curing tool 4; and the space between the vertical supports 32 and 42 is used for extracting the core from the machine 100.

Furthermore, when the tools 1, 2, 3 and 4 must be replaced with other tools 1, 2, 3 and 4 with a different configuration, said tools 1, 2, 3 and 4 can be stacked like a column, as depicted by way of example in FIG. 1B (together with the frame 7, if there is one), and said tools 1, 2, 3 and 4 can all be taken out of the respective working and operating positions together through the space between the vertical supports 22 and 42 or through the space between the vertical supports 22 and 32, and the new tools 1, 2, 3 and 4 can all be arranged in the respective working and operating positions together. In these positions, the lower shaping tool is fixed and the remaining tools are associated with their respective articulated arm 21, 31 and 41 in order thus make cores.

The machine 100 can further comprise an upper horizontal platform 5, each vertical support 22, 32 and 42 being fixed to said upper horizontal platform 5 by a respective upper end, said vertical supports 22, 32 and 42 being part of the structure of the machine 100 acting as pillars. The actuation means 10, for example, which cause the movement and actuation of the hold-down means 9 acting on the tools 3 and 4, are arranged on the upper platform 5, and the machine 100 does not require additional structural elements for supporting said elements on said upper horizontal platform 5 since the vertical supports 22, 32 and 42 also act as pillars for supporting said upper horizontal platform 5 and said elements, which allows freeing up more space and making access to the different elements of the machine 100, for example, easier.

The machine 100 can further comprise a lower horizontal platform 6, the vertical supports 22, 32 and 42 being fixed to said lower horizontal platform 6 by a respective lower end opposite the corresponding upper end, although they could be fixed directly to the ground without having to use a lower horizontal platform 6.

Figure 3:
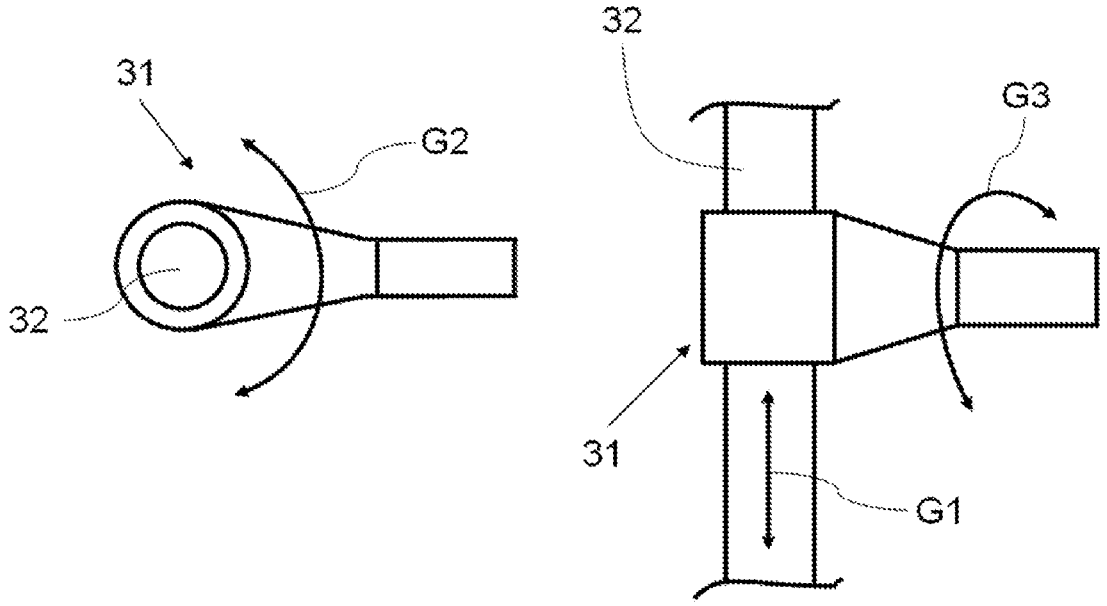
FIG. 3 shows an articulated arm where the three degrees of freedom of the articulated arm are depicted.

Each articulated arm 21, 31 and 41 of the machine 100 has three degrees of freedom G1, G2 and G3, as depicted in FIG. 3 with respect to the first articulated arm 31, which are the degrees of freedom that are required and sufficient for making sand cores in the machine 100: a vertical movement G1 of the corresponding articulated arm 21, 31, 41, a rotational movement G2 of the corresponding articulated arm 21, 31, 41, and a swinging movement G3 of the corresponding articulated arm 21, 31, 41. Furthermore, each articulated arm 21, 31 and 41 preferably comprises an end suitable for supporting the corresponding tool 2, 3 and 4, and each tool 2, 3 and 4 comprises an area configured for cooperating with said end of the corresponding articulated arm 21, 31 and 41. This cooperation is preferably performed by means of a tongue and groove connection.

Although the machine 100 shown in the figures comprises a lower shaping tool and an upper shaping tool, the sand core making machine can also be used with other sand core making types, such as the sand core making by means of the additive manufacturing. In additive manufacturing a sand layer is transferred on a platform of the machine or to a box of said machine (operating position), subsequently the resin or other equivalent material is transferred on the previous sand layer, with the desired shape, and the layers of sand and resin are so transferred in an alternating manner, and as many layers as required. Once as many layers as required are transferred, the material arranged on the platform (or in the box) is hardened to obtain the final sand core. The hardening can be done applying heat for example. Therefore, for this type of core making the machine comprises a platform or a box instead of the upper and lower shaping tools. In this case, in addition, the transfer tool can be adapted for transferring the sand and the resin (for example when moving in one direction it applies the sand layer, and when moving back it applies the resin layer) or it could comprise two coordinated transfer tools (one for the sand and another one for the resin) or it could comprise as many transfer tools as required. The curing tool in this case would not apply any fluid over the transferred material by the transfer tool (or by the transfer tools), and it could be adapted for heating said material for example. The machine would comprise, in this case, at least one articulated arm for moving the required tools, although, preferably, it would comprise an articulated arm for each one of said tools.

The following clauses disclose in an unlimited way additional implementations, with each clause representing an implementation.

Clause 1: A sand core making machine comprising at least one transfer tool (3) by means of which the material for making the core is transferred when said transfer tool (3) is moved to an operating position, and a curing tool (4) by means of which the material previously transferred by the transfer tool (3) is hardened and which is arranged in an operating position over said material to perform said hardening once the transfer tool (3) has moved out of its operating position, characterized in that it comprises at least one articulated arm (31, 41) for moving the transfer tool (3) and the curing tool (4) to the respective operating position.

Clause 2: The sand core making machine according to clause 1, comprising a first articulated arm (31) for moving the transfer tool (3) to its operating position, and a second articulated arm (41) for moving the curing tool (4) to its operating position.

Clause 3: The sand core making machine according to clause 2, comprising at least one vertical support (32, 42) for supporting the articulated arms (31, 41) of the machine (100), said articulated arms (31, 41) being vertically movable on the respective vertical support (32, 42), said articulated arms (31, 41) being attached to their corresponding vertical support (32, 42) with rotational freedom.

Clause 4: The sand core making machine according to clause 3, comprising a first vertical support (32) for supporting the transfer tool (3) and a second vertical support (42) for supporting the curing tool (4).

Clause 5: The sand core making machine according to clause 4, comprising a lower shaping tool (1) and an upper shaping tool (2) between which a cavity (11) with the shape required for the core is formed when said shaping tools (1, 2) are one above the other in a working position, the transfer tool (3) being adapted for being disposed over said cavity (11) to transfer the material to said cavity (11), the machine (100) comprising a third articulated arm (21) for moving the upper shaping tool (2) and arranging it on the shaping tool (1) to generate the cavity (11) between both shaping tools (1, 2).

Clause 6: The sand core making machine according to clause 5, comprising a third vertical support (22) for supporting the third articulated arm (21) of the machine (100), said articulated arm (21) being vertically movable on said vertical support (22) and said third articulated arm (21) being attached to said vertical support (22) with rotational freedom.

Clause 7: The sand core making machine according to clause 6, wherein the three vertical supports (22, 32, 42) are arranged such that they coincide with the vertexes of a triangle.

Clause 8: The sand core making machine according to clause 7, wherein the shaping tools (1, 2) are arranged in the center of the triangle when they are in the working position.

Clause 9: The sand core making machine according to clause 7 or 8, wherein the distance between the third vertical support (22) and the first vertical support (32) is such that when the upper shaping tool (2) is moved, said upper shaping tool (2) does not collide with the first vertical support (32), and when the transfer tool (3) is moved, said transfer tool (3) does not collide with the third vertical support (22), and wherein the distance between the third vertical support (22) and the second vertical support (42) is such that when the curing tool (4) is moved, said curing tool (4) does not collide with the third vertical support (22).

Clause 10: The sand core making machine according to any of clauses 6 to 9, comprising an upper horizontal platform (5) which is supported on the vertical supports (22, 32, 42), said vertical supports (22, 32, 42) being part of the structure of the machine acting as pillars.

Clause 11: The sand core making machine according to any of the preceding clauses, wherein each articulated arm comprises an end suitable for supporting the corresponding tool, said end having a swinging movement with respect to the rest of the articulated arm, and each of said tools comprises an area configured for cooperating with said end of the corresponding articulated arm, said cooperation being carried out by means of a tongue and groove connection.

What is claimed is:

1. A sand core making machine comprising:

a transfer tool by means of which a material for making a sand core is transferred when the transfer tool is in a first operating position;

a curing tool by means of which the material previously transferred by the transfer tool is hardened and which is arranged in a second operating position over the material to perform the hardening once the transfer tool has moved out of the first operating position; and at least one articulated arm for moving the transfer tool and the curing tool to and away from the respective first and second operating position.

2. The sand core making machine according to claim 1, comprising a first articulated arm for moving the transfer tool to and away from the first operating position, and a second articulated arm for moving the curing tool to and away from the second operating position.

3. The sand core making machine according to claim 2, comprising at least one vertical support for supporting the first and second articulated arms, the first and second articulated arms being vertically movable on the at least one vertical support, the first and second articulated arms being attached to the at least one vertical support with rotational freedom.

4. The sand core making machine according to claim 2, comprising a first vertical support for supporting the transfer tool and a second vertical support for supporting the curing tool, the first articulated arm being vertically movable on the first vertical support and being attached to the first vertical support with rotational freedom, the second articulated arm being vertically movable on the second vertical support and being attached to the second vertical support with rotational freedom.

5. The sand core making machine according to claim 4, further comprising a lower shaping tool having a first working position and an upper shaping tool having a second working position, the lower and upper shaping tools configured such that when each of the lower and upper shaping tools is respectively in the first and second working position a cavity bounded by the lower and upper shaping tools is formed, the upper shaping tool being disposed above the lower shaping tool when the lower and upper shaping tools are respectively in the first and second working positions, the transfer tool being disposed over the cavity to transfer the material to the cavity when the transfer tool is in the first operating position, the sand core making machine including a third articulated arm that is configured to move the upper shaping tool to and away from the second working position.

6. The sand core making machine according to claim 5, further comprising a third vertical support that supports the third articulated arm, the third articulated arm being vertically movable on the third vertical support and being attached to the third vertical support with rotational freedom.

7. The sand core making machine according to claim 6, wherein the first, second and third vertical supports are arranged such that they coincide with the vertexes of a triangle.

8. The sand core making machine according to claim 7, wherein the lower and upper shaping tools are arranged inside the triangle when respectively arranged in the first and second working positions.

9. The sand core making machine according to claim 8, wherein a distance between the third vertical support and the first vertical support permits the upper shaping tool to be moved into and out of the triangle between the first and third vertical supports, and wherein the distance between the third vertical support and the second vertical support permits the curing tool to be moved into and out of the triangle between the second and third vertical supports.

10. The sand core making machine according to claim 7, wherein a distance between the third vertical support and the first vertical support permits the upper shaping tool to be moved into and out of the triangle between the first and third vertical supports, and wherein the distance between the third vertical support and the second vertical support permits the curing tool to be moved into and out of the triangle between the second and third vertical supports.

11. The sand core making machine according to claim 6, further comprising an upper horizontal platform that is supported on the first, second and third vertical supports.

12. The sand core making machine according to claim 11, further comprising hold-down means supported on the upper horizontal platform, the hold-down means being configured to hold the transfer tool against the upper shaping tool.

13. The sand core making machine according to claim 12, wherein the hold-down means is also configured to hold the curing tool against the upper shaping tool.

14. The sand core making machine according to claim 6, wherein the third vertical support is located at a point of a first virtual line perpendicular to a second virtual line that joins the first and second vertical supports.

15. The sand core making machine according to claim 6, wherein the upper shaping tool is moveable between the first and third vertical supports and/or the second and third vertical supports.

16. The sand core making machine according to claim 6, wherein the transfer tool is moveable between the first and second vertical supports and/or the first and third vertical supports.

17. The sand core making machine according to claim 6, wherein the curing tool is moveable between the first and second vertical supports and/or the second and third vertical supports.

18. The sand core making machine according to claim 6, wherein the upper shaping tool is moveable between the first and third vertical supports and/or the second and third vertical supports, the transfer tool is moveable between the first and second vertical supports and/or the first and third vertical supports, and the curing tool is moveable between the first and second vertical supports and/or the second and third vertical supports.

19. The sand core making machine according to claim 2, wherein the first articulated arm has an end having a swinging movement with respect to a remainder of the first articulated arm, the transfer tool having an area configured for cooperating with the end of the first articulated arm, the cooperation being carried out by a first tongue and groove connection.

20. The sand core making machine according to claim 19, wherein the second articulated arm has an end having a swinging movement with respect to a remainder of the second articulated arm, the curing tool having an area configured for cooperating with the end of the second articulated arm, the cooperation being carried out by a second tongue and groove connection.

* * * * *